US005584309A

United States Patent [19]

De Beneditis et al.

[11] Patent Number: 5,584,309

[45] Date of Patent: Dec. 17, 1996

[54] METHOD OF TREATING HAIR IN WHICH A PART OF A LENGTH OF A TRESS OF HAIR PROTECTED WHILE ANOTHER PART OF THE LENGTH OF THE TRESS OF HAIR IS TREATED

[76] Inventors: Alfredo De Beneditis, 30 Falcon Avenue, Springfield, Milton Keynes, Buckinghamshire; Mark C. Lawrence, 20 Waterslade Green, Luton, Bedfordshire LU3 2ER, both of Great Britain

[21] Appl. No.: 558,250

[22] Filed: Nov. 17, 1995

Related U.S. Application Data

[63] Continuation of Ser. No. 428,474, Apr. 26, 1995, abandoned, which is a continuation of Ser. No. 221,988, Apr. 1, 1994, abandoned, which is a continuation of Ser. No. 944,060, Sep. 11, 1992, abandoned.

[30] Foreign Application Priority Data

Sep. 13, 1991 [GB] United Kingdom ..... 9119557

[51] Int. Cl.[6] ..... A61K 7/13; A45D 7/00

[52] U.S. Cl. ..... 132/208; 132/270; 132/210

[58] Field of Search ..... 132/200, 204, 132/205, 206, 210, 212, 208, 270

[56] References Cited

U.S. PATENT DOCUMENTS

| | | | |
|---|---|---|---|
| 1,550,930 | 8/1925 | Sullivan | 132/212 |
| 1,637,147 | 7/1927 | Lewis | 132/222 |
| 2,171,885 | 9/1939 | Michael | 132/210 |
| 2,397,908 | 4/1946 | Altman | 132/210 X |
| 2,819,721 | 1/1958 | Zakon | 132/208 |
| 3,101,724 | 8/1963 | Nizetich | 132/270 |
| 3,103,933 | 9/1963 | Sanzo | 132/270 |
| 3,548,842 | 12/1970 | McCall | 132/222 |
| 3,599,647 | 8/1971 | Fabbri | 132/270 |
| 3,805,810 | 4/1974 | Savala | 132/270 |
| 3,889,692 | 6/1975 | Redrow | 132/210 |
| 4,637,411 | 1/1987 | Sanders | 132/212 |
| 5,007,443 | 4/1991 | Fulgoni | 132/270 |
| 5,016,657 | 5/1991 | Bustance et al. | 132/202 |
| 5,090,428 | 2/1992 | Greene et al. | 132/204 |

FOREIGN PATENT DOCUMENTS

| | | |
|---|---|---|
| 0085587 | 8/1984 | European Pat. Off. . |
| 2595927 | 9/1987 | France . |
| 671910 | 5/1952 | United Kingdom . |
| 701380 | 12/1953 | United Kingdom . |
| 719613 | 12/1954 | United Kingdom . |
| 728460 | 4/1955 | United Kingdom . |
| 2028652 | 3/1980 | United Kingdom . |
| 9103963 | 4/1991 | WIPO . |

*Primary Examiner*—Melvyn I. Marquis
*Assistant Examiner*—Robert H. Harrison
*Attorney, Agent, or Firm*—Lee, Mann, Smith, McWilliams, Sweeney & Ohlson

[57] ABSTRACT

A method treating hair with a liquid treatment substance is disclosed in which lengths of hair which are not to receive treatment are protected by means of a tubular protection device which is impervious to the liquid treatment substance. The tubular protection device comprises an open ended tube of thin rubber and one end of the tube is rolled upon itself to form an annular rolled portion with an end portion protruding therefrom. In use, the end of a length of hair to be protected is inserted into the end portion and the-rolled portion is unrolled to an extent sufficient to enclose all the length of hair to be protected. The protected hair and unprotected hair is rolled onto a curler and the liquid treatment substance is applied to the rolled hair. The protection device serves to prevent the liquid treatment substance coming into contact with the length of hair enclosed within the tube.

5 Claims, 3 Drawing Sheets

METHOD OF TREATING HAIR IN WHICH A PART OF A LENGTH OF A TRESS OF HAIR PROTECTED WHILE ANOTHER PART OF THE LENGTH OF THE TRESS OF HAIR IS TREATED

CROSS REFERENCES TO RELATED APPLICATIONS

This application is a continuation of Ser. No. 08/428,474 filed Apr. 26 1995 now abandoned which is a continuation of 08/221,988 filed Apr. 1, 1994 now abandoned which is a continuation of Ser. No. 07/944,060 filed Sep. 11, 1992 now abandoned.

BACKGROUND OF THE INVENTION

This invention relates to a method of treating human hair and to apparatus for use in the method of treatment. In particular the invention relates to a method of protecting portions of hair during treatment of other portions of hair.

In one known treatment for human hair, known as root perming, newly grown hair is subjected to a treatment which imparts a permanent waving to the hair. This treatment of the hair causes damage to the hair and hence it is desirable to restrict the treatment such that only those portions of hair newly grown since a previous treatment are treated. In order to restrict the treatment to the newly grown hair, the hair which has been treated previously is protected to inhibit treatment thereof. It will be appreciated that the previously treated hair, which it is desired to protect from receiving further treatment, are those portions of hair remote from the scalp whereas the newly grown untreated hair, which is to receive treatment, are those portions of hair between the scalp and the portions treated previously. In a known method of protecting the treated hair from receiving further treatment, rectangular covers of paper material are folded round those portions of tresses of hair which are not to be treated. The free edges of the covers have adhesive thereon so that after folding the cover around a tress of hair the free edges are brought into adhering engagement to retain the cover in a closed position around the tress of hair. The cover together with the hair enclosed therein is rolled from the end remote from the scalp on a curler toward the scalp so that the portion of hair to be treated is rolled on the exterior of the cover and the hair enclosed therein. The cover and hair rolled on the curler is then secured in position. The hair is then subjected to treatment by application of a chemical substance in liquid form to the rolled hair. The covers enclosing portions of hair which are not to be subjected to treatment are only partially effective in preventing ingress of the liquid chemical substance and as a result hair which is enclosed in the covers but is close to the ends of the covers, and which it is intended not to be treated, becomes subjected to the treatment.

SUMMARIES OF THE INVENTION

According to one aspect of the invention a method of treating hair in which a first part of a length of hair is to be untreated and a second part of the length of hair is to be treated includes the steps of providing a protecting device comprising an open ended tube of rubber; inserting the first part of the length of hair into the tube so that said first part of the hair extends within and along the length of said tube; rolling the first part of the length of hair enclosed in said tube and the second part of the length of hair onto a curler; and then applying a liquid substance to treat said second part of the hair while said first part of the hair is protected from treatment by said liquid substance by said protecting device.

According to another aspect of the invention a method of protecting a first part of a length of hair while a second part of the length of hair is subjected to treatment by a liquid substance includes the steps of providing a protecting device comprising an open ended tube of rubber; inserting the first part of the length of hair into the tube; and rolling the first part of the length of hair contained in the tube and the second part of the length of hair onto a curler.

According to a further aspect the invention encompasses, for use in combination with a curler and a liquid treatment substance for treating a first length of hair, a protection device for protecting a second length of said hair from treatment by said treatment substance comprising an open ended tube of rubber in a contracted lengthwise state and extendible from said contracted state along said second length of hair to enclose said second length of hair.

The invention also encompasses a protection device for protecting a first length of hair from treatment by a liquid treatment substance applied to a second length of said hair comprising an open ended tube of rubber in a contracted lengthwise state and extendible from said contracted state along said first length of hair to enclose said first length of hair.

BRIEF DESCRIPTION OF THE DRAWING

A method of treating hair and a protection device in accordance with the invention will now be described by way of example with reference to the drawings in which.

DESCRIPTION OF THE PREFERRED EMBODIMENTS

Figure 1:
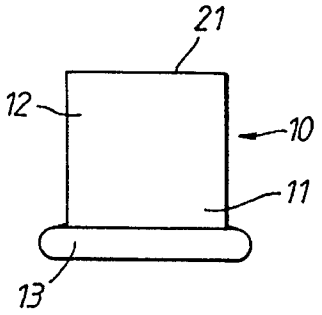
FIG. 1 shows a view of a protection device for protecting hair from treatment, the device being shown prior to application to the hair.

Referring first to FIG. 1, a device 10 for protecting a portion of hair from treatment by a liquid chemical substance comprises an open ended tube 11 of thin rubber material. The one end of the tube is rolled along the length of the tube to form an annular rolled up portion 13 and the other end 12 of the tube is left protruding from the rolled up portion 13 to facilitate application of the device 10 to hair to be protected.

Figure 2A:
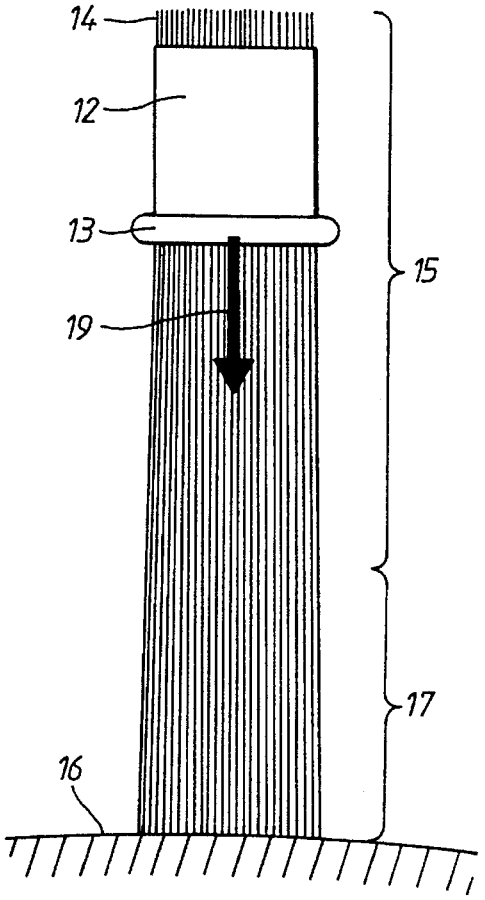
FIGS. 2*a*, 2*b*, 2*c* and 2*d* show respectively steps in the application of the protection device to a portion of hair to be protected and rolling of the protected and unprotected hair to be treated onto a curler.
Figure 2B:
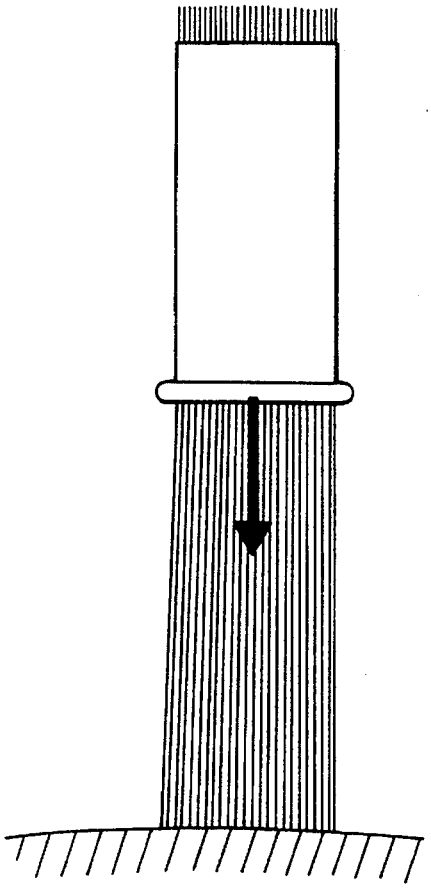
Figure 2C:
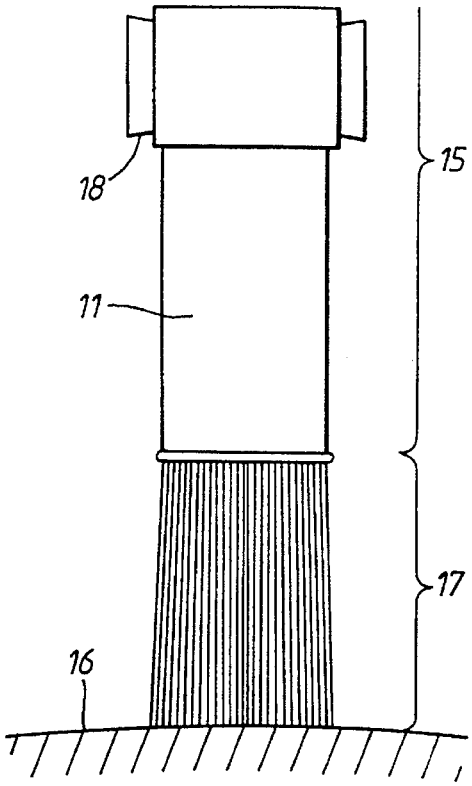
Figure 2D:
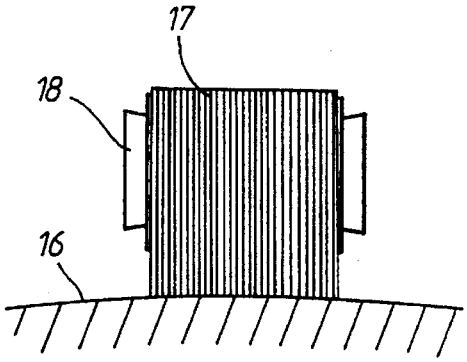

Referring now to FIGS. 2*a*, 2*b*, 2*c* and 2*d*, a free end 14 of a length 15 of a tress of hair which is not to be treated is passed into the device 10 so that it extends through the end portion 12. The end portion 12 and the ends of the hair therein are then held by thumb and forefinger of the user and the rolled up portion 13 is gently unrolled over the tress of hair in the direction of the arrow 19 toward the scalp 16 as shown in FIGS. 2*a* and 2*b* until at least all the length of the hair 15, not to be treated, is enclosed within the tube 11 of the device 10 as shown in FIG. 2*c*. Preferably the device is unrolled slightly beyond the hair 15 which is not to be treated so as to overlap or cover a small length of the hair 17 which it is intended to treat. A perm curler 18 (FIG. 2*c*) is then placed on the end portion 12 of device 10 and the device together with the hair 15 is rolled onto the curler 18. Rolling of the hair onto the curler 18 is continued until not only the hair 15 within the device 10 is rolled on the curler but also the length of newly grown hair 17 between the length 15 and the scalp 16 is rolled onto the curler 16 as shown in FIG. 2*d* and is secured to the curler. It will be appreciated that in rolling the device 10 and the hair within it onto the curler, the cross section of the device 10 becomes flattened and narrow in form and provides an impervious barrier which closely conforms to the length of the tress of hair enclosed thereby. After rolling of the hair onto the curlers, a liquid chemical treatment substance is applied to the rolled hair to effect the required treatment. It will be appreciated that the liquid chemical treatment substance is able to permeate that part 17 of the tress of hair rolled onto the curler but not enclosed in the protection device 10 and the protection device 10 is tightly pressed against the part 15 of the tress of hair and provides an impervious barrier to ingress of the liquid treatment substance and thereby prevents the liquid treatment substance permeating to any significant extent the part 15 of the tress of hair which is required to remain untreated.

Figure 3:
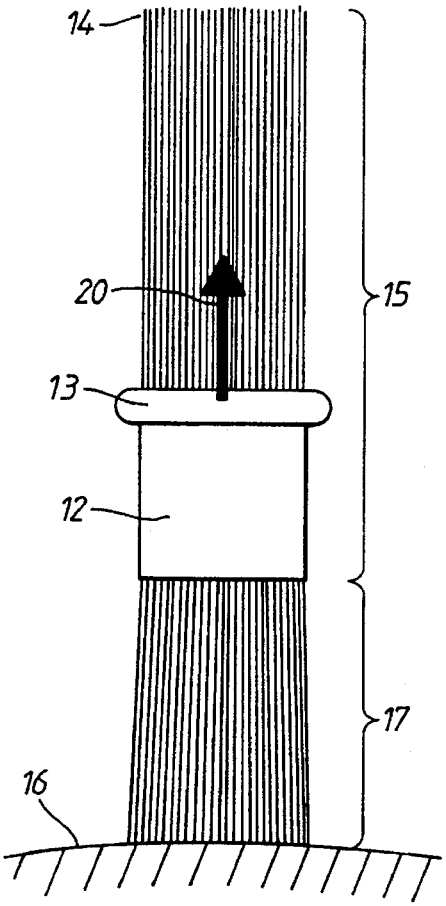
FIG. 3 shows an alternative method of applying the protection device to a portion of hair to be protected.

Instead of placing the free end 14 of the length 15 of the tress of hair in the end portion 12 and rolling the rolled up portion 13 toward the scalp 16 the device may be applied to the length 15 of hair by drawing the entire length 15 to be protected through the end portion 12 with the rolled up portion 13 lying toward the free end 14 of the length 15 and then unrolling the rolled up portion 13 in the direction of arrow 20 away from the scalp to the free end 14 of the hair as is illustrated in FIG. 3.

Figure 4:
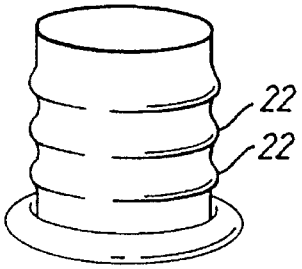
FIGS. 4, 5 and 6 show the protection device initially supported on different forms of holder respectively.

The thickness of the material of which the tubular protection device is formed is chosen to be sufficiently small as to facilitate rolling of the device and the hair onto a curler without increasing the diameter of the curled hair to any substantial extent while at the same time being sufficiently large to prevent passage therethrough of liquid chemical treatment substances to any significant extent. Due to the small thickness of the material the end portion 12 has little rigidity and this may result in difficulty in handling the protection device and in initial insertion of the hair into the portion 12. Handling of the device and initial insertion of the hair into the device may be facilitated by forming the end portion 12 to be stiffer or more rigid than the remainder of the length of the tube 11. Increased rigidity of the end portion 12 may be provided by forming one or more ribs on the end portion. For example a rib 21 forming a lip on the open end of the end portion 12 may be formed on the end portion 12 as shown in FIG. 1 or the end portion may be formed with a plurality of annular ribs or corrugations 22 as shown in FIG. 4 spaced along the length of the end portion. The end portion 12 may be moulded to have a required profile. Instead of, or in addition to the annular ribs or corrugations, the end portion may be formed with ribs or corrugations extending lengthwise of the end portion 12. In a further modification the end portion 12 may be formed with one or more ribs or corrugations inclined at an acute angle to the length of the end portion 12.

Figure 5:
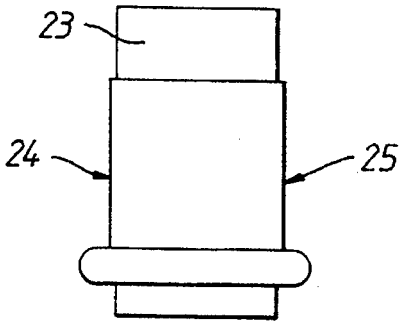
Figure 6:
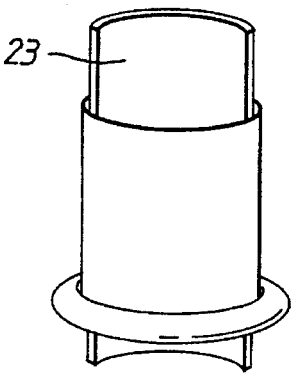
Figure 7:
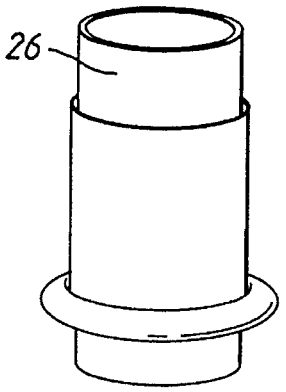
FIG. 7 shows an alternative mode of supporting the protection device on a holder.

Instead of forming the end portion 12 with means to stiffen the end portion, the stiffening of the end portion 12 may be effected by mounting the protection device on a former or holder extending into or through the end portion 12 as shown in FIG. 5, 6 and 7. The former 23 may comprise a flat element 23 as shown in FIG. 5 which upon manual application of pressure to opposite edges 24, 25 becomes arcuate, FIG. 6, to hold end portion 12 and the rolled up portion 13 of the protection device in an open generally cylindrical state. After insertion of the tress of hair, the manual pressure applied to the former is terminated and the portion 13 is unrolled to enclose the hair. The former 23 or holder is withdrawn from the end portion 12 prior to rolling the hair on a curler. If desired instead of a flat former 23 or holder which is distorted by manual pressure to hold the protection device in an open state, the former 23 or holder may be curved as shown in FIG. 6 or a generally cylindrical former 23 as shown in FIG. 7 to hold the protection device in an open state. The cylindrical former 23 may be distortable by manual pressure into a flattened cross section to facilitate manual gripping of the hair, inserted into the device, while unrolling the portion 13 to enclose the desired length of hair.

Figure 8:
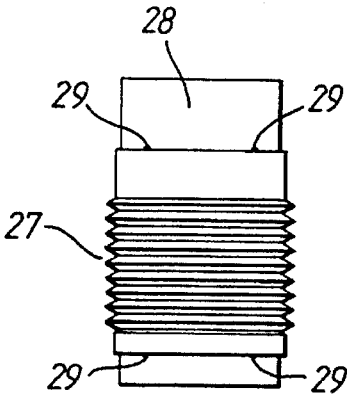
FIG. 8 shows a protection device in which an end portion thereof is stiffened.

As hereinbefore described the tube forming the protection device initially is partially rolled and after insertion of the hair into the tube, the rolled portion 13 is unrolled to an extent sufficient to enclose the desired length of hair 15. Instead of the portion being initially in a rolled state it may instead be gathered in concertina fashion, as shown at 27 in FIG. 8, onto a former 23 and after insertion of the hair into the tube, the gathered portion 27 is drawn from the former manually to extend over and enclose the desired length of hair. The former is then withdrawn from the tube prior to rolling the hair together with the tube onto a curler.

If desired, in order to prevent accidental separation or release of the tube 11 from the former, parts 29 of the tube, for example in the region of the open end of the portion 12 may be releasably secured to the former for example by one or more non-permanent adhesive bonds or frangible connections. In respect of the protection device shown in FIG. 8 parts 29 at both ends of the tube may be releasably secured to the former.

One use envisaged for the device 10 is for protecting a length of hair from treatment by a chemical substance which effects permanent waving of the hair. However the device may be used for other treatments of hair by liquid substances in which it is desired to protect lengths of hair from such treatment. An example of such other treatment is dyeing, colouring or tinting. While it is preferred to make the device 10 of rubber, it may be formed of other materials having the same or similar properties to rubber. Accordingly the term rubber as used in the specification and claims is to be understood to include such other materials, for example synthetic plastics materials, having the same or similar properties as regards flexibility, elasticity, imperviousness to liquid chemical treatment substances and ability to withstand the effects of any heat applied to the hair in the course of treatment thereof. A convenient size for the tube is approximately 1.5 inches (38 mm) in diameter. The tube may be provided in a variety of lengths to accommodate different hair lengths and may be cut to any desired shorter length by the user. When the protection device is provided in the form of a flat sheet the dimensions of the sheet are selected to enable the sheet to be wrapped around a length of a tress of hair so as to enclose the hair and inhibit the ingress of chemical treatment substances.

While the protection device may be utilised to protect a desired length of hair from treatment by a treatment liquid when rolled on a curler such that the hair is progressively rolled upon hair already rolled on the curler, it will be appreciated that the protection device may be utilised in protecting a desired length of hair from treatment in which the hair is rolled spirally on an elongate curler.

We claim:

1. A method of protecting a first length of a tress of hair while treating a second length of said trees of hair with a liquid hair treatment substance including the steps of inserting the first length of the tress of hair through a first open end of an elongate open ended flexible tube to extend lengthwise of said tube and said second length of said tress of hair extending externally of said tube; rolling said flexible tube containing said first length of said tress of hair and said second length of said tress of hair onto hair rolling means to cause the flexible tube to closely conform to said first length of said tress of hair and form a substantially impervious barrier to said liquid hair treatment substance and then applying said liquid hair treatment substance to treat said second length of said tress of hair, whereby said flexible tube provide a substantially impervious barrier between said first length of said tress of hair and said liquid hair treatment substance.

2. A method as claimed in claim 1 wherein initially the elongate open ended flexible tube is in a contracted lengthwise state and a part of the first length of the tress of hair is inserted through the first open end of the flexible tube to extend within the flexible tube in said contracted lengthwise state and including the step of extending said flexible tube lengthwise from said contracted lengthwise state of said flexible tube to an extent sufficient for said first length of said tress of hair to extend wholly within said flexible tube when so extended.

3. A method as claimed in claim 2 wherein initially the elongate open ended tube in the contracted lengthwise state is supported on a holder extending within the tube and including the step after insertion of the first length of the tress of hair into the tTube of withdrawing the holder from within the tube followed by the step of extending the tube lengthwise from the contracted state to an extent sufficient for said first length of said tress of hair to extend wholly within said flexible tube when so extended.

4. A method as claimed in claim 2 wherein initially the holder maintains the flexible the in a contracted lengthwise state and in a flattened cylindrical form and including the step, prior to insertion of the first length of the tress of hair into the tube, of deforming the holder such as to open the flexible tube to thereby facilitate said insertion of said first length of said tress of hair into said flexible tube.

5. A method as claimed in claim 2 wherein initially a first portion of length of the flexible tube is rolled to form an annular rolled portion and when the first length of the tress of hair is inserted into the tube said first length of said tress of hair extends through said annular rolled portion and including the step of unrolling the annular rolled portion to an extent sufficient to enclose all of said first length of said tress of hair within the flexible tube.

* * * * *